US007257929B2

(12) United States Patent
Ceysson et al.

(10) Patent No.: US 7,257,929 B2
(45) Date of Patent: Aug. 21, 2007

(54) ASSEMBLING MODULE FOR FLOOR OR WALL COVERINGS

(75) Inventors: Olivier Ceysson, Bollene (FR); Olivier Thill, Bollene (FR); Freddy Bosc, Pierrelatte (FR)

(73) Assignee: Geflor, Villeurbanne (FR)

( * ) Notice: Subject to any disclaimer, the term of this patent is extended or adjusted under 35 U.S.C. 154(b) by 131 days.

(21) Appl. No.: 10/883,239

(22) Filed: Jul. 1, 2004

(65) Prior Publication Data

US 2004/0231284 A1 Nov. 25, 2004

Related U.S. Application Data

(63) Continuation of application No. PCT/FR03/002952, filed on Oct. 8, 2003.

(30) Foreign Application Priority Data

Oct. 14, 2002 (FR) ..... 02 13025

(51) Int. Cl.
*E04F 15/22* (2006.01)

(52) U.S. Cl. ..... 52/403.1; 52/181; 52/412; 52/392

(58) Field of Classification Search ..... 428/423.9, 428/349; 52/403.1, 181, 410, 412, 413, 390, 52/392, 389, 309.17, 309.14, 309.8, 386
See application file for complete search history.

(56) References Cited

U.S. PATENT DOCUMENTS 2,529,799 A * 11/1950 Crockett ..... 442/326
4,772,500 A 9/1988 Stroppiani
4,832,152 A * 5/1989 Schuelke et al. ..... 181/290
4,879,148 A * 11/1989 Neaves et al. ..... 428/41.8
5,286,555 A * 2/1994 Reed ..... 442/60
5,824,415 A * 10/1998 Kanki et al. ..... 428/411.1
5,891,294 A * 4/1999 Shih et al. ..... 156/307.7
5,932,337 A * 8/1999 Edinger et al. ..... 428/319.3
6,212,838 B1 * 4/2001 Eda ..... 52/403.1
6,308,491 B1 * 10/2001 Porter ..... 52/794.1
6,558,786 B1 * 5/2003 Jupina ..... 428/316.6
6,571,497 B1 * 6/2003 Aylward et al. ..... 40/615
6,599,599 B1 * 7/2003 Buckwater et al. ..... 428/40.1

(Continued)

FOREIGN PATENT DOCUMENTS

DE 296 11 303 U1 9/1996

(Continued)

*Primary Examiner*—Richard E. Chilcot, Jr.
*Assistant Examiner*—Chi Q. Nguyen
(74) *Attorney, Agent, or Firm*—Heslin Rothenberg Farley & Mesiti, P.C.; Jeff Rothenberg, Esq.

(57) ABSTRACT

A module includes at least an associated two-layer structure with one first layer being a polymer base layer highly loaded with mineral fillers contributing to the rigidity of the module, and a second layer made from a printed polymer film defining the decorative part of the module, and the protection of the decorative part. An outer surface of a rigidifying base layer is designed to form a spacer means in the form of a plate of dimensions substantially greater than the format of the module, over all or part thereof, to constitute after abutment of the modules and/or edge jointing of the plate edges, a zone for receiving a sealant such as a binder, putty and like bonding.

10 Claims, 5 Drawing Sheets

U.S. PATENT DOCUMENTS 6,718,714 B1 * 4/2004 Montgomery, Sr. ..... 52/392

FOREIGN PATENT DOCUMENTS

DE 100 45 475 A1 4/2002

EP 203 042 11/1986

EP 625 170 11/1994

WO WO93/15135 8/1993

* cited by examiner

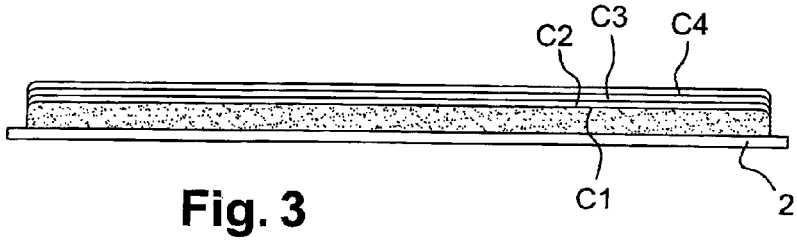
Fig. 3
Fig. 11
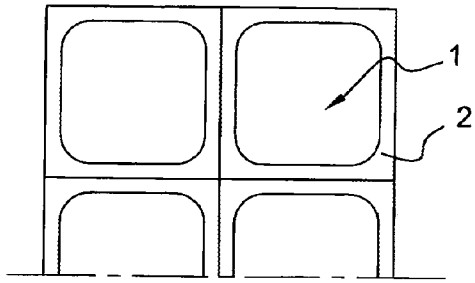
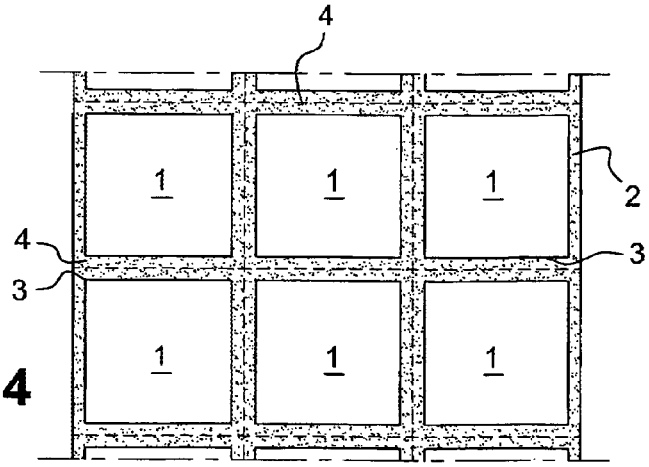
Fig. 4
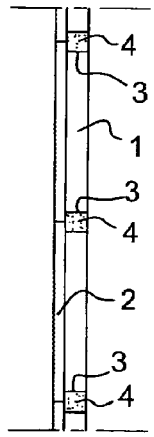
Fig. 5

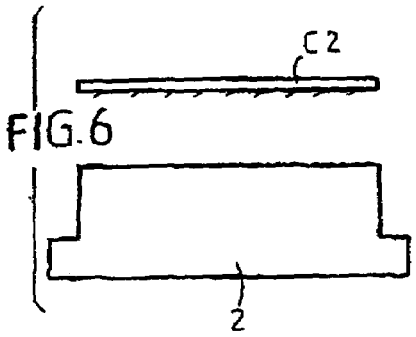
FIG.6
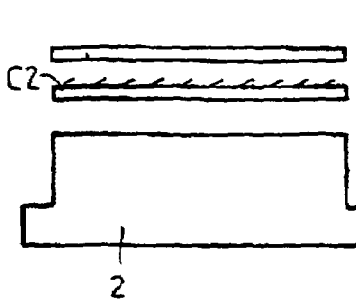
FIG.7
FIG.8
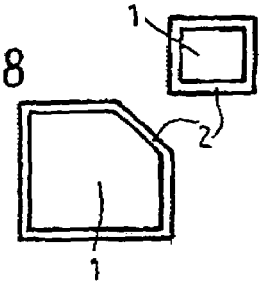
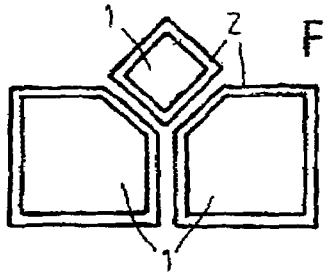
FIG.9
FIG.10
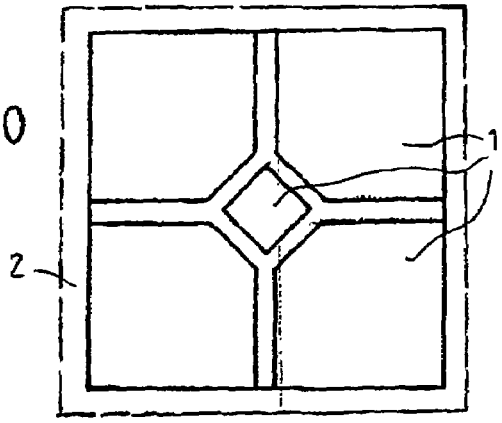

ASSEMBLING MODULE FOR FLOOR OR WALL COVERINGS

CROSS REFERENCE TO RELATED APPLICATIONS

This application is a continuation of International Application PCT/FR03/002952 filed on Oct. 8, 2003, and published in French as International Publication WO 2004/035960 on Apr. 29,2004 and claims priority of French patent application number 02.13025 filed on Oct. 14, 2002, the complete contents of these applications being incorporated by reference herein.

BACKGROUND OF THE INVENTION

The invention relates to an assembly module made of synthetic material and having the appearance of tiling for floor and/or wall coverings.

The invention relates to the technical field of covering floors and walls with prefabricated modules which may be of the tiling, ceramic, terracotta or parquet type, or made of woven or nonwoven materials of the carpet type, or of synthetic materials.

The use of square modules is well known per se and they have become popular because they are practical to lay and change in the event of damage. Furthermore, there is the possibility of laying out the modules in personalized decorative configurations, which presents an undeniable advantage.

Modules in the form of tiling in ceramic, terracotta and similar materials have the disadvantage that they are heavy, their edges chip easily and they can be damaged by impact. In addition, their properties and capacities in terms of heat and/or sound insulation are very limited. Moreover, when laying them it is necessary to first prepare a smooth screed. This demands a degree of skill.

The use is also known of modules in the form of tiles made from woven or nonwoven textiles of the carpet type. In addition to the great deformability of this type of tiles, there are the conventional drawbacks that they collect dust, acarids, and are difficult to clean.

Also known are modules in the form of tiles made of synthetic material that look like tiling. These are described in patent EP 203 042 MONDO, comprising a layered structure with a thick part forming a core and two layers of flexible, substantially inextensible synthetic material, between which is an intermediate separating layer. The covering thus made in the form of tiles is delimited along its sides by tapered peripheral edges which define rounded edges on the upper face.

Also known, from patent EP 625 170, are tiles made of synthetic material having a multilayer ceramic appearance.

The tiles thus made in particular in patents EP 203 042 and EP 625 170, are placed edge to edge when assembled and binders, glues or the like are used on the one hand to bond them to the relevant support surface and on the other hand to join them together. In this case, said binder is inserted into the space for jointing of the tiles at their rounded edges, as shown for example in the MONDO patent.

Although advantageous, the various embodiments mentioned above do not allow for a variation in the decorative effect, the tiles being essentially square.

Furthermore, when positioned edge to edge in assembly, the binder or glue part is generally flush with their upper plane and the desired imitation-ceramic effect is lost.

BRIEF SUMMARY OF THE INVENTION

The applicant decided to research a new design of assembly module for floor and/or wall coverings that could optimize all the current knowledge and uses with their properties.

The applicant therefore decided to research an optimized design of this type of module made of synthetic material which allows a better reproduction of the ceramic tile effect.

Another aim was to break away from the conventional effects of positioning the tiles in squares through a new design of the module.

These aims and others will emerge from the rest of the description.

According to a first characteristic of the invention, the assembly module for floor and/or wall coverings is of the type comprising at least an associated two-layer structure, a first layer being a polymer base layer highly loaded with mineral fillers contributing to the rigidity of the module, and a second layer made from a printed polymer film defining the decorative part of the module, and the protection of the decorative part, said module being noteworthy in that the outer surface of the rigidifying base layer is designed to form a spacer means in the form of a plate of dimensions substantially greater than the format of the module, over all or part thereof, to constitute, after abutment of the modules and/or edge jointing of the plate edges, a zone for receiving a jointing such as a material binder, a mastic and the like.

According to another characteristic, the module is laid out in a configuration of varied shapes and dimensions with the spacer means corresponding to the shapes and dimensions and outline of the module, the final covering presenting an assembly of identical or different modules depending on the decorative effect chosen, each module consisting of a pattern.

According to another characteristic, the module is designed to itself represent an assembly of several modules including the appearance of fitting-together and jointing zones.

According to another characteristic, the module comprises a third layer in the form of a transparent polymer film.

According to another characteristic, the module comprises a fourth layer superposed on the third layer and being defined by a protective polymer varnish.

These and other characteristics will clearly emerge from the rest of the description.

BRIEF DESCRIPTION OF THE DRAWINGS

FIG. 3 is a profile view of the module according to FIG. 2.

FIG. 4 is a view of a set of pre-positioned modules according to the invention in the implementation according to FIGS. 1 and 2.

FIG. 5 is a view in cross section along the line A-A of FIG. 4.

FIGS. 6 and 7 are diagrammatic views illustrating the module according to the invention with the printed films in different positions.

FIG. 8 is an overall view of two modules of different configurations intended to be assembled according to a specific pattern.

FIG. 9 is a view according to FIG. 8, with the modules assembled.

FIG. 10 is a view of a single module according to the invention, laid out flat, the module itself being decorated with several modules together with depiction of the jointing zones.

FIG. 11 is a variant view of a module according to the invention with an internal depiction in the form of a disk.

DETAILED DESCRIPTION

Figure 1:
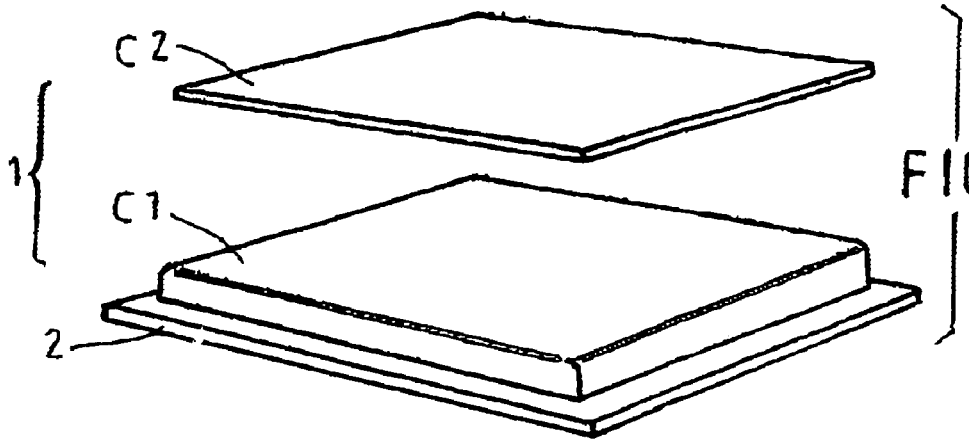
FIG. 1 is an exploded perspective view of the module according to the invention with a two-layer structure, with the spacer means.
Figure 2:
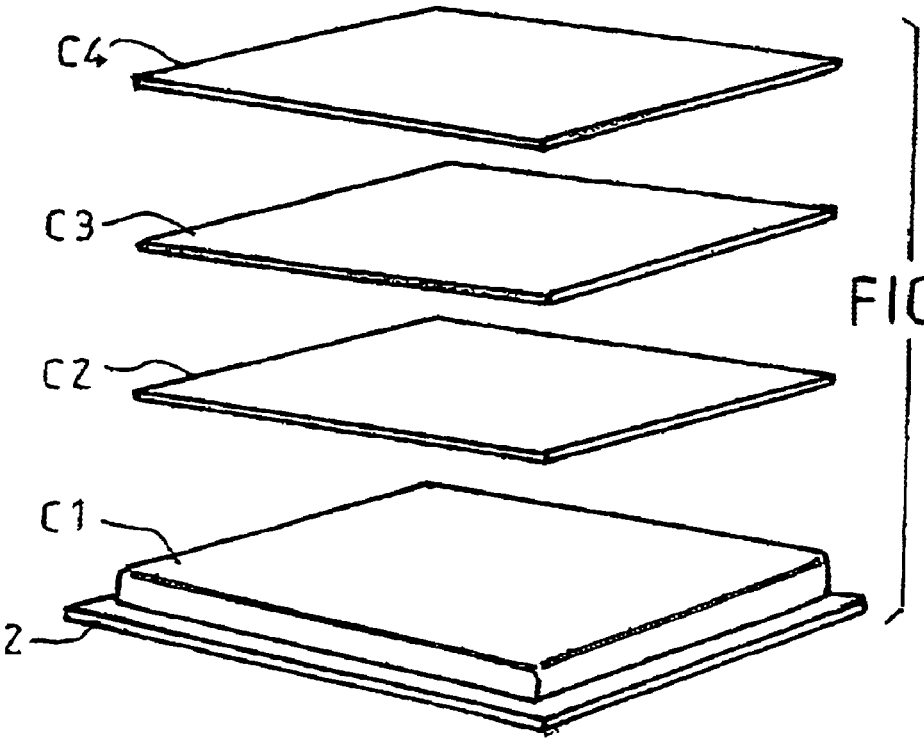
FIG. 2 is an exploded perspective view of the module according to the invention in four layers, with the spacer means.

To give a clearer idea of the subject of the invention, preferred embodiment will now be described in a non-limiting manner with the figures of the drawings.

The assembly module for wall and floor coverings according to the invention bears the general reference (1). It may be made in the form of a square tile, in the form of a rectangular strip, or in other forms. It is a thick, rigid tile, shown in a first non-limiting example in a square format, of variable dimensions which may be, by way of non-limiting example, of the order of 300 to 500 millimeters each side. The module is made in the form of a multilayer structure with at least two layers (Cl) (C2). The first layer is the bottom base layer intended to come into contact with the floor and/or wall surface, and it is made of polymer highly loaded with mineral fillers. This first layer is associated on its upper face with a second layer (C2), defined by a printed polymer film, contributing to the decorative part of the module, and the protection of the decorative part. Said layers may possibly receive a third layer (C3) consisting of a transparent polymer film, and a fourth layer (C4) in the form of polymer varnish of the polyurethane or some other type. This varnish may contain special agents that give a structured, rough, etc. Surface. The module is made with a multilayer structure and may have a thickness of around 4 to 8 millimeters, the base layer (C1) constituting the bulk of this thickness. Referring to FIGS. 6 and 7, the printing may be placed on the underside of the second layer, or on the top side of said layer, with a third, protective layer.

Preferably, said thickness may be around 6 millimeters. The mass per unit area is from 8 kg/m$^2$ to 16 kg/m$^2$, and preferably around 12 kg/m$^2$.

The upper peripheral edging (1.1) of the module may be rounded, chamfered, beveled, or have any other profile, on each of its edges to fulfill a dual role, namely on the one hand to protect the surface film, i.e. either the printed film or the transparent film, or both, to prevent it scratching off owing to wear. Furthermore, this rounded edging confers on the module a ceramic effect. The printed polymer film constituting the second layer is made with the desired decorative effect. The layers are joined together by various manufacturing techniques, such as calendering, or hot pressing, by way of non-limiting example.

The module according to the invention is designed and provided, under the bottom layer (C1), with a specific spacer means (2). The spacer means is made of any suitable material with a degree of rigidity, and it is characterized by being of substantially larger dimensions than the module so that it protrudes, over all or part of the module, in the manner of a peripheral surround (2*a*). The spacer means has straight edges (2*b*) so that it is possible when creating a decorative effect to lay out a set of modules as shown in FIG. 4. The junction between the edgings of every two spacers defines a lower flat reception zone (3) at the level of the module creating a channel for the positioning of a jointing seal (4). This embodiment is even more similar to the known presentations of tiling and how the tiles are laid.

The spacer means is advantageously made directly with the rigidifying base layer and, being thus made of the same material, the whole is then obtained in a single step, by pressing, or by machining or other methods.

The module thus presents this characteristic appearance as shown in the figures of the drawings, with this bottom part consisting of the spacer.

As a variant, the spacer may be made of a different material from the base layer and be either attached to it or bonded by any suitable means, or obtained during manufacture. The spacer may protrude only partially from the format of the tile. For example, this protrusion may be made only on two adjacent sides of the module, if the module is square. All other arrangements may be envisioned to help create decorative effects.

The spacer also makes it possible to have very regular dimensions. Depending on the embodiment, it is possible to have different spacing seal widths based on the laying-out of several modules to create various esthetic effects.

This original arrangement of the invention is particularly advantageous since it considerably, increases the scope for creation of decorative effects, on the receiving floor or wall surfaces.

FIGS. 8 and 9 show an embodiment of two modules of different shapes, the first being a square with one corner cut off and the second a smaller square. The assembly of these shapes is partially depicted in FIG. 9.

In FIG. 11, by virtue of its spacer part the module is of square section for example, but an inner decorative part represents, in a novel, original manner, a ceramic in the form of a disk.

In FIG. 10, the module according to the invention is made with a single base including the bottom part forming the spacer. According to this solution, the module itself consists of a decorative part representing an arrangement of smaller modules. In this embodiment, the zones for jointing between the small modules are also shown.

Thus, according to the invention, sets of modules with multiple decorative effects are obtained.

Figure 12:
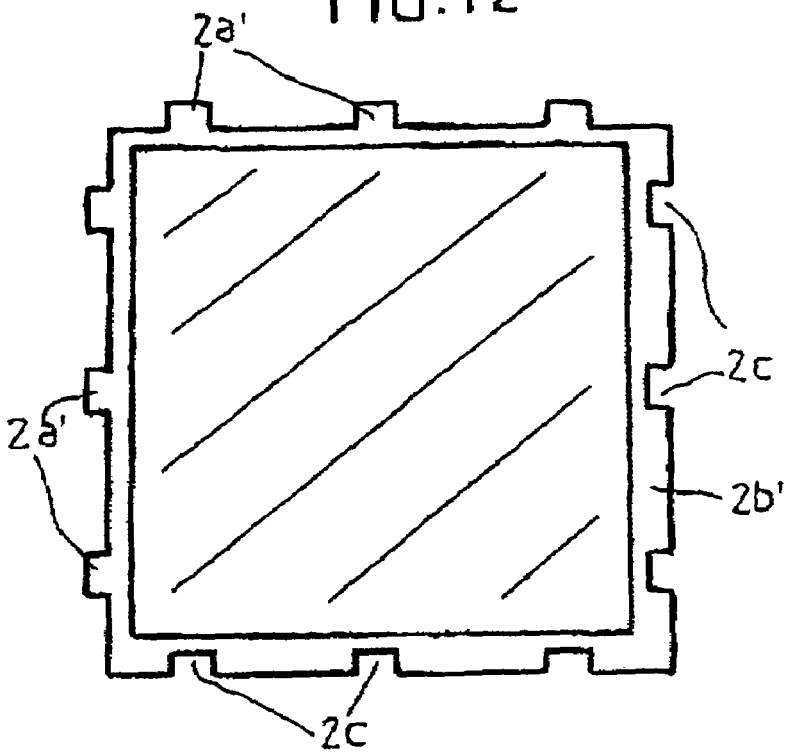
FIGS. 12 and 13 are views of modules laid out flat, according to two ways of assembling them together.
Figure 13:
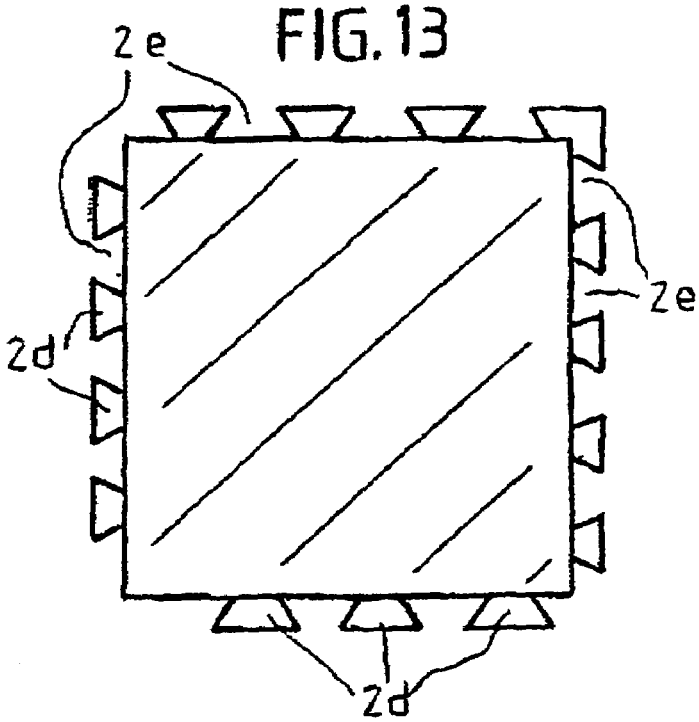
Figure 14:
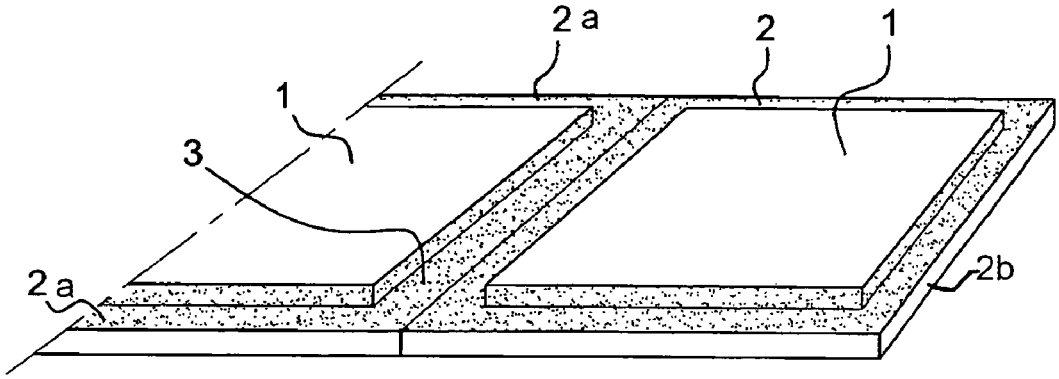
FIG. 14 is a perspective partial view of two adjacent modules of the type shown in FIGS. 1-3 prior to positioning of a jointing seal in a channel formed atop abutting spacer means.
Figure 15:
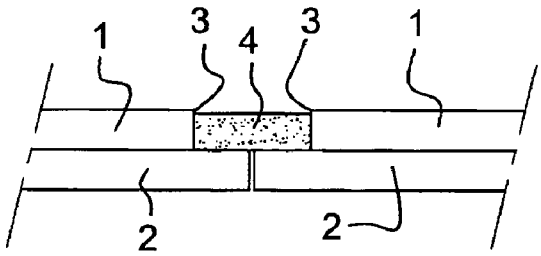
FIG. 15 is a cross-sectional view of a junction formed by adjacent modules and having a jointing seal provided in said channel.

Also shown in FIGS. 12 and 13 are two variants depicting the assembling of modules. In general, the protruding spacer means has, around its periphery, male and female assembly means for the fitting together of several modules.

According to the embodiment of FIG. 12, this spacer means of the module, depicted by way of example in the form of a square tile, has two adjacent sides where the protruding part comprises a plurality of projections 2*a*' that correspond in number, themselves protruding from the protruding zone 2*a*' of the spacer.

The other two sides have, in said zone 2*b*', notches (2*c*) whose profile corresponds to and complements said projections 2*a*', to allow their engagement. Thus, this embodiment not only ensures that the modules can be fit together but also the positioning and location of the modules with respect to one another is facilitated.

In the variant of FIG. 13, the spacer is shaped with a plurality of projections (2*d*), with a dovetail profile, being arranged along the sides of the module in respective offset positions, and complementary spaces (2*e*) between two consecutive projections to allow fitting-together and interlinking.

The advantages of the invention lie in the fact that the modules thus constituted are both rigid and lightweight and are, by virtue of the base layer, almost undeformable, the spacer part allowing their relative positioning. Furthermore, the implementation of this invention makes it possible to obtain modules offering better acoustic insulation, better heat insulation and better impact strength.

Another advantage is that the modules may be cut by any means. Furthermore, it is also possible to envision manufacturing plates of modules on which are marked zones for breaking and shearing by a cutter, jigsaw or the like, for the formats in question. The modules are lighter than tiling and are easy to lay.

The module thus designed according to the invention is positioned on the floor or wall covering and is held in place using an adhesive that either may be made integral with the module at the time of manufacture, by removing the protection for the adhesive layer, or it is the support plane that is provided with and directly receives the adhesive.

In an advantageous embodiment, use may be made of a binder glue dispensed using a dispenser such as a glue gun, by way of non-limiting example. Glue is deposited in spots spread out over each module, so that it is applied partially, in a varied arrangement, and, after jointing the modules to one another, the module-layer can fill the spaces in the junction parts of the spacer. Thus, laying is quick and presents no particular problems. The thickness of each module easily absorbs differences in level at the surface of the floor or wall to be covered.

The invention claimed is:

1. An assembly module for at least one of floor and wall decorative coverings, said module comprising:

at least an associated two-layer structure, one first layer comprising a polymer base layer with mineral fillers contributing to rigidity of the module, said first layer having an upper surface and an opposite bottom surface, and a second layer made from a printed polymer film defining a decorative part of the module and protection of the decorative part, said second layer being joined to the upper surface of the first layer, a periphery of said second layer defining a format of the module, the bottom surface of the first layer comprising a plate-shaped spacer of dimensions substantially greater than the format of the module, over all or part of said periphery, to constitute after abutment of at least two of the modules and edge jointing of spacer edges, a zone for receiving a jointing material.

2. The module of claim 1 wherein a final covering comprises an assembly of said module and at least one identical module, each module comprising a pattern, and jointing material filling said zone.

3. The module of claim 2 wherein said assembly further comprises at least one different module.

4. The module of claim 1 wherein the spacer is made so as to protrude on at least two adjacent sides.

5. The module of claim 1 further comprising a third layer comprising a transparent polymer film.

6. The module of claim 5 further comprising a fourth layer superposed on the third layer and comprising a protective polymer varnish.

7. The module of claim 1 wherein the module comprises a multilayer structure having a thickness of around 4 to 8 millimeters and a mass per unit area of between 8 $kg/m^2$ and 16 $kg/m^2$.

8. The module of claim 7 wherein the thickness is around 6 millimeters and the mass per unit area is around 12 $kg/m^2$.

9. A method of laying the module of claim 1, comprising depositing spots of glue on an underside of the module, and volumes of glue in a reception zone formed by adjacent edgings of spacers of consecutive adjacent modules.

10. The module of claim 1 wherein a final covering comprises an assembly of said module and at least one different module, each module comprising a pattern, and jointing material filling said zone.

* * * * *